US007804409B2

(12) United States Patent
Munro et al.

(10) Patent No.: US 7,804,409 B2
(45) **Date of Patent: *Sep. 28, 2010**

(54) RF CONTROLLED DEVICES TO INCREASE COMPLIANCE WITH HANDWASHING PROTOCOLS

(75) Inventors: Andrew D. Munro, Durham, NC (US); Robert G. Munro, Durham, NC (US)

(73) Assignee: Duke University, Durham, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/477,399

(22) Filed: Jun. 3, 2009

(65) Prior Publication Data

US 2009/0237254 A1 Sep. 24, 2009

Related U.S. Application Data

(63) Continuation of application No. 11/743,880, filed on May 3, 2007, now Pat. No. 7,605,704.

(60) Provisional application No. 60/746,324, filed on May 3, 2006, provisional application No. 60/746,327, filed on May 3, 2006, provisional application No. 60/746,330, filed on May 3, 2006, provisional application No. 60/823,375, filed on Aug. 23, 2006, provisional application No. 60/823,378, filed on Aug. 23, 2006, provisional application No. 60/823,379, filed on Aug. 23, 2006, provisional application No. 60/824,600, filed on Sep. 5, 2006, provisional application No. 60/824,601, filed on Sep. 5, 2006.

(51) Int. Cl.
*G08B 13/14* (2006.01)

(52) U.S. Cl. ..... 340/572.1; 340/10.1; 340/539.13; 340/573.1; 340/686.1; 4/623; 222/52; 251/129.01; 251/129.04

(58) Field of Classification Search ..... 340/572.1, 340/10.1, 539.1, 539.13, 573.1, 5.2, 606, 340/686.1, 691.6, 692, 573.4, 573.5; 4/623, 4/628, 639; 222/52; 251/129.01, 129.04
See application file for complete search history.

(56) References Cited

U.S. PATENT DOCUMENTS

| | | | | | |
|---|---|---|---|---|---|
| 4,606,085 | A * | 8/1986 | Davies | 4/623 |
| 4,896,144 | A * | 1/1990 | Bogstad | 340/691.6 |
| 5,202,666 | A * | 4/1993 | Knippscheer | 340/573.1 |
| 5,793,653 | A * | 8/1998 | Segal | 702/176 |
| 5,812,059 | A * | 9/1998 | Shaw et al. | 340/573.1 |
| 5,945,910 | A * | 8/1999 | Gorra | 340/573.1 |

(Continued)

*Primary Examiner*—Davetta W Goins
(74) *Attorney, Agent, or Firm*—Ostrolenk Faber LLP

(57) ABSTRACT

A system for monitoring compliance with handwashing protocols by a plurality of workers, each worker carrying a wireless tag having a worker identifier, the monitoring being performed in a facility having a plurality of areas, the system comprising a plurality of wireless tag reader/transmitters each having an area identifier, at least one wireless tag reader/transmitter being positioned in each of the areas and each wireless tag reader/transmitter being capable of reading the worker identifier stored in the wireless tag when the worker is within range of the wireless tag reader/transmitter and further capable of transmitting the worker and area identifiers to at least one computing device; and at least one of said wireless tag reader/transmitters being disposed at a handwashing station; wherein the at least one wireless tag reader/transmitter reads the worker identifier when the worker manipulates a device at the handwashing station dispensing a washing substance and transmits the worker and area identifiers to the at least one computing device.

4 Claims, 10 Drawing Sheets

U.S. PATENT DOCUMENTS 5,952,924 A * 9/1999 Evans et al. ..... 340/573.1
5,954,069 A * 9/1999 Foster ..... 134/57 R
6,031,461 A * 2/2000 Lynn ..... 340/573.1
6,125,482 A * 10/2000 Foster ..... 4/623
6,147,607 A * 11/2000 Lynn ..... 340/573.1
6,195,588 B1 * 2/2001 Gauthier et al. ..... 700/11
6,211,788 B1 * 4/2001 Lynn et al. ..... 340/573.1
6,236,317 B1 * 5/2001 Cohen et al. ..... 340/573.1
6,392,546 B1 * 5/2002 Smith ..... 340/573.1
6,426,701 B1 * 7/2002 Levy et al. ..... 340/573.1
6,727,818 B1 * 4/2004 Wildman et al. ..... 340/573.1
6,882,278 B2 * 4/2005 Winings et al. ..... 340/573.1
6,956,498 B1 * 10/2005 Gauthier et al. ..... 340/825.69
6,975,231 B2 * 12/2005 Lane et al. ..... 340/573.1
7,015,816 B2 * 3/2006 Wildman et al. ..... 340/573.1
7,242,307 B1 * 7/2007 LeBlond et al. ..... 340/573.1
7,315,245 B2 * 1/2008 Lynn et al. ..... 340/540
7,372,367 B2 * 5/2008 Lane et al. ..... 340/573.1
7,443,305 B2 * 10/2008 Verdiramo ..... 340/573.5
7,477,148 B2 * 1/2009 Lynn et al. ..... 340/540
2002/0135486 A1 * 9/2002 Brohagen et al. ..... 340/573.1
2002/0183979 A1 * 12/2002 Wildman ..... 702/188
2004/0193449 A1 * 9/2004 Wildman et al. ..... 705/2
2005/0035862 A1 * 2/2005 Wildman et al. ..... 340/573.1
2005/0248461 A1 * 11/2005 Lane et al. ..... 340/573.1
2006/0132316 A1 * 6/2006 Wildman et al. ..... 340/573.1
2007/0096930 A1 * 5/2007 Cardoso ..... 340/573.4
2007/0182571 A1 * 8/2007 Kennish et al. ..... 340/573.1

* cited by examiner

RF CONTROLLED DEVICES TO INCREASE COMPLIANCE WITH HANDWASHING PROTOCOLS

CROSS-REFERENCE TO RELATED APPLICATIONS

This is a continuation of U.S. patent application Ser. No. 11/743,880 filed May 3, 2007, now U.S. Pat. No. 7,605,704, entitled RF CONTROLLED DEVICES TO INCREASE COMPLIANCE WITH HANDWASHING PROTOCOLS, which application is based on and claims priority to U.S. Provisional Patent Application Ser. Nos. 60/746,324, filed on May 3, 2006 and entitled ANTISEPTIC HANDRUB CRADLE WITH RFID SIGNAL GENERATOR, 60/746,327, filed on May 3, 2006 and entitled WALL MOUNTED SOAP DISPENSER WITH RFID SIGNAL GENERATOR, 60/746,330, filed on May 3, 2006 and entitled FAUCET EXTENDER WITH RFID SIGNAL GENERATOR, 60/823,375, filed on Aug. 23, 2006 and entitled DISPOSABLE ALCOHOL HANDRUB CANISTER WITH INTEGRATED RFID SIGNAL GENERATOR, 60/823,378, filed on Aug. 23, 2006 and entitled DISPOSABLE SOAP POUCH WITH INTEGRATED RFID SIGNAL GENERATOR, 60/823,379, filed on Aug. 23, 2006 and entitled FOMITE WIPE DISPENSER WITH RFID SIGNAL GENERATOR, the entire contents of which are hereby incorporated by reference, 60/824,600, filed on Sep. 5, 2006 and entitled ALCOHOL HANDRUB CANISTER WITH EXTENSION TAB/CANISTER HOLDER WITH INTEGRATED RFID SIGNAL GENERATOR, 60/824,601, filed on Sep. 5, 2006 and entitled DISPENSER (HANDRUB OR SOAP) WITH INTEGRATED RFID SIGNAL GENERATOR, the entire contents of which are hereby incorporated by reference.

BACKGROUND OF THE INVENTION

The present invention relates to ensuring compliance of healthcare staff with handwashing protocols and more particularly to using wireless devices for ensuring compliance with the handwashing protocols.

Society incurs a great cost due to nosocomial (hospital-acquired) infections, both in human suffering and in healthcare expenditures. It is estimated that each year two million people acquire infections while visiting or being cared for in the hospital. About 5% of these infected, i.e., nearly one hundred thousand people, die from those infections. Pennsylvania hospitals, for example, billed the Medicare and Medicaid systems $1.4 billion dollars in 2004 for treatment of nosocomial infections in approximately nine thousand patients. This averages to a cost of about $154,000 per infection. Patients are becoming increasingly aware of the scope of the problem, producing a mounting threat of hospital liability lawsuits based upon nosocomial infections.

Long ago nosocomial infections were identified as a major problem, with healthcare workers' hands determined to be the main means of infection and disease transmission. Accordingly, protocols were devised instructing healthcare workers to clean their hands with warm water and soap, or with an antiseptic handrub, before and after every patient contact. However, despite relentless educational and motivational efforts, no major study has shown compliance with these protocols to be greater than 50%. In other words, on average, healthcare workers only wash their hands about half the recommended number of washings.

An anonymous survey of healthcare workers, described in "*Infect Control Hosp Epidemiol*" 2000; 21:381-386, Pittet D., listed the following reasons for non-compliance with handwashing protocols or why healthcare workers often fail to do something so simple and with well-documented benefits:

Handwashing agents cause skin irritation and dryness;
Sinks are inconveniently located;
Lack of soap and paper towels;
Too busy/insufficient time;
Understaffing/overcrowding;
Patient needs take priority; and
Low risk of acquiring infection from patients.

The issue can be examined, using Duke University Healthcare Systems (DUHS) as an example. DUHS employs about 5,000 nurses. If each nurse works three shifts a week, at twelve hours per shift, with ten patient contacts per hour, then the handwashing requirement for the DUHS nursing corps is 90,000,000 handwashings annually. Currently, enforcement of handwashing protocols is essentially nonexistent, as awareness of infractions is essentially nonexistent.

A situation thus exists in which many healthcare workers are failing to wash their hands as directed, even though they are well aware of the requirement to do so. When the healthcare workers are not intrinsically motivated to perform the required action, they must then be extrinsically motivated. Extrinsic motivation falls into two general categories: reward and punishment. The decision of punishing or rewarding an action, however, depends on the awareness of that action by the individual healthcare workers.

SUMMARY OF THE INVENTION

It is an object of the present invention to increase awareness of the need to wash hands among individual workers.

It is another object of the present invention to increase awareness of the actions, i.e., handwashing, of workers among the management staff of medical and other facilities.

A system is provided for monitoring compliance by a plurality of workers carrying wireless tags having worker identifiers with handwashing protocols in a facility having a plurality of areas. The system includes a plurality of wireless tag reader/transmitters having area identifiers for reading the worker identifiers stored in the wireless tags when the worker is positioned a predetermined distance from any of the plurality of wireless tag reader/transmitters and transmitting worker and area identifiers to at least one computing device; and at least one cleanser dispensing apparatus positioned in an area having at least one wireless tag reader/transmitter, the at least one cleanser dispensing apparatus alerting the at least one wireless tag reader/transmitter to read the worker identifiers and transmitting the worker and area identifiers.

Other features and advantages of the present invention will become apparent from the following description of the invention that refers to the accompanying drawings.

DETAILED DESCRIPTION OF EMBODIMENTS OF THE INVENTION

In order to comprehensively gauge compliance with handwashing protocols, a system must track the passage of the workers in and out of various areas, i.e., patients' rooms, examination facilities, lavatories, lunch room, the street, etc., as well as proper usage of handwashing stations before and after patient encounters. The present invention proposes using wireless means, for example, radio frequency identification (RFID), to provide real-time tracking of individual workers during daily shifts and collecting historical databases of such daily gathered information for providing extrinsic motivation, i.e., rewarding and/or punishing the individual workers.

Figure 8:
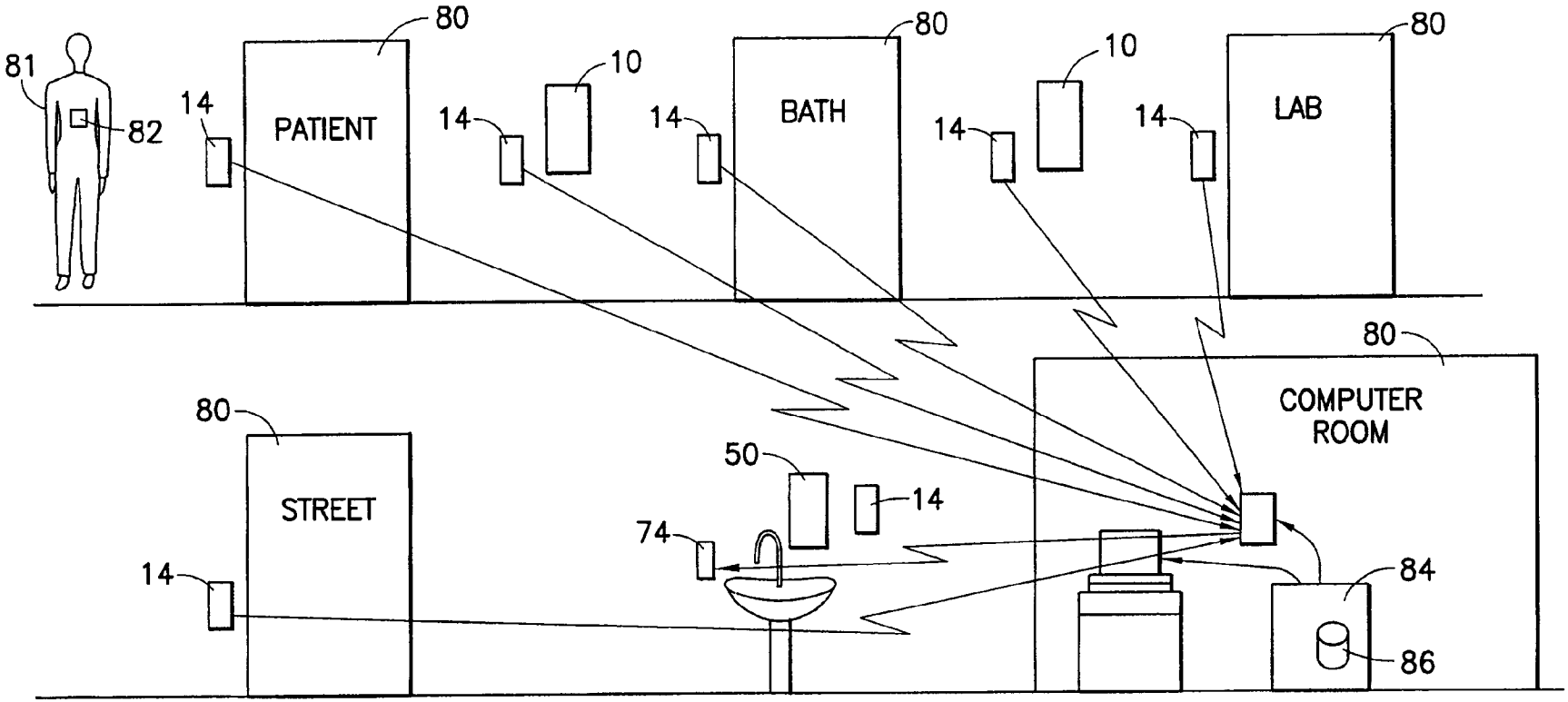
FIG. 8 is a diagram of a facility utilizing the present invention.

To implement the invention as illustrated in FIG. 8, a facility, e. g., a hospital, a nursing home, a medical office, a laboratory, and the like, are required to identify each area on each floor with a tag reader/transmitter 14, e.g., RFID reader/transmitter, having a unique area 80 identifier. Similarly, each permanent, temporary, or visiting worker must receive a unique identifying tag, such as an RFID tag, a chip, bar code, etc. The tag may be formed as a badge, a bracelet, or similar non-intrusive items.

Thus when the worker wearing the unique identifying tag 82 enters an area 80 having the tag reader/transmitter 14, the tag reader/transmitter 14 will read the unique identifier from the worker's tag and transmit the unique worker identifier along with the tag reader/transmitter's own identifying information to a computing device 84 located on or off site of the facility's premises. The transmission of the information to the computing device can be achieved via wired or wireless means and in a manner well known to those skilled in the art. Because, as stated above, the system is aware of the positioning of the tag reader/transmitters 14, it may easily determine the location of the worker wearing the unique identifying tag 82 from the known position of the individual tag reader/transmitters 14 that sent the signal.

Alternatively, biometrics may be used instead of tags, e.g., finger prints, retinal scans, face recognition, and the biometrics data identify individual workers at the computing device.

The computing device will then store the received information along with a time-stamp in a database 86. Thus, after collecting the information for a preset time, e.g., a few hours, a report may be procured using the collected information. The report will unambiguously show paths and whereabouts of the workers wearing the tags. The information can be collected on per-shift, weekly, monthly, quarterly, and annual bases. The collected information allows the facility management to reward or punish the workers. Moreover, the collected information may be used for various other purposes, such as, statistical analysis of worker productivity.

Upon arrival at the facility, each worker 81 is required to don their unique identifying tag 82. When entering areas 80 equipped with strategically positioned tag reader/transmitters 14, the workers' tags are non-intrusively detected and noted as an entry in the database 86. After performing required duties the worker exits the area 80, which is duly detected and noted in the database 86 by the tag reader/transmitter 14. Alternatively, the invention may record only the entry or exit of the worker 81 as required by the facility's management.

According to one embodiment of the present invention, after exiting a designated area, e.g., a lavatory, patient area, etc., the worker will be allotted a discrete amount of time, e.g., 30 seconds, to report to a handwashing station. Those skilled in the art will be familiar with means to utilize the computing device having the information of ingress and egress recorded together with the time of the action to create a real time or a report alert if the allotted period is exceeded.

In accordance with the present invention, the workers may be allotted credits for compliance with the facility instituted handwashing protocols. The allotted credits are accumulated over some predefined period and compared to a predetermined compliance goal. As discussed above, the detected compliance can be used by the facilities to reward and/or punish the individual workers.

When the tag of a particular worker is detected by the tag reader/transmitter placed within a certain distance of the handwashing station 10, 50, e.g., 12 inches, that information is recorded and the worker will receive a credit for being at the handwashing station. However, merely being near the handwashing station does not prove the actual washing of the hands. Compliance with the facility instituted handwashing protocol is necessary for receiving a full credit. Alternately, the signals generated by both the apparatus and the worker may both be detected/received by a remote tag reader that is not a part of the apparatus itself.

The present invention assures compliance by the workers with the medical facility instituted handwashing protocols. This is achieved by using handwashing apparatus that provides wireless control signals, e.g., RF signals. This apparatus may be equipped with the tag readers/transmitters 14 that generate signals identifying the apparatus (and therefore its location) and the worker having the tag that is using the apparatus and sends the signals to the computing device. As above, all information is stored in the database includes the time-stamp. Alternately, the apparatus may continuously read and transmit the worker's tag identifying information and transmit the handwashing apparatus identifying information only as a consequence of usage.

The first signal is generated when the worker initiates handwashing. A proximal tag reader/transmitter is alerted to read and report the worker's tag. Optionally and preferably, when handwashing is complete the tag reader/transmitter is alerted again to report the event of completion. The difference between the time stamps of the start and completion of handwashing indicates a duration of handwashing. This allows the computing device to easily confirm not only compliance by the workers with the instituted handwashing protocols, but also spot malicious or incomplete compliance.

The handwashing protocol may include rules, for example, directing workers to perform handwashing within 1 minute after exiting areas A, B, K, and Z and to perform handwashing within 10 seconds before entering areas C, D, and L. Timing guidelines for the handwashing protocol for individual handwashing apparatus as well as for individual workers may be entered and modified in a compliance guideline database on the computing device in a manner commonly known to those skilled in the art.

Furthermore, a reader/transceiver may be integrated into the handwashing station apparatus may receive the identity information of the worker and transmits both the worker and apparatus identifiers to another reader/transceiver for further transmission to the computing device. In another scenario, the apparatus may transmit its identity information when it is manipulated, but not the identity information of the worker. The worker's identity information is transmitted separately. Both sets of information are received by a reader/transceiver for further transmission to the computing device. Multiple reader/transceivers may be used to determine workers' location.

Dispensing Cleansing Substance Used without Water

Figure 1A:
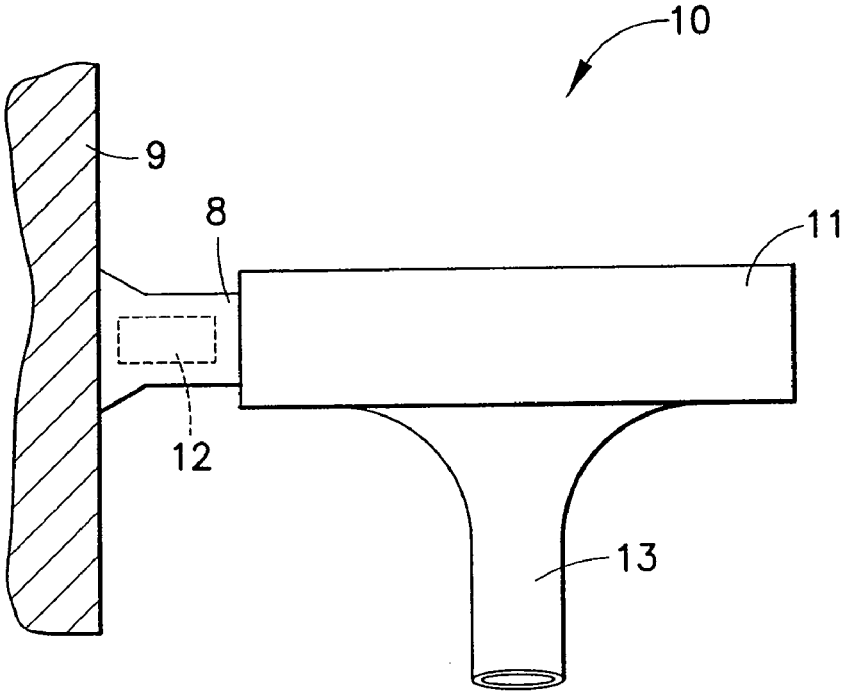
FIGS. 1*a* and 1*b* are side- and top-view diagrams of an apparatus dispensing cleansing substance of the present invention for use without water.
Figure 1B:
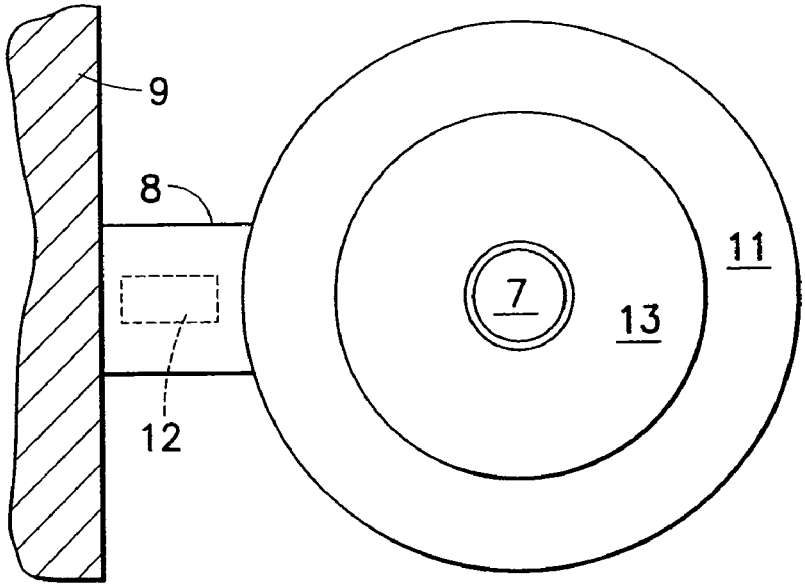

As illustrated in FIGS. 1*a*-1*b*, in one embodiment, the apparatus of the present invention includes a dispensing apparatus 10 having a wireless transceiver 12, e.g., RF transceiver, and a tag reader/transmitter 14. The dispensing apparatus 10 includes a cradle 11 and a sensor 13. The sensor is illustrated as a jacket but may be any appropriate sensor coupled to the cradle 11. The cradle 11 is fastened to a wall or other holding means 9 via a mounting bracket 8 that includes the wireless transceiver 12. Movement of the sensor 13 (shown as a jacket) alerts the wireless transceiver 12 to generate and send a signal. Return of the sensor 13 to the original position may if desired alert the wireless transceiver 12 to generate a second signal.

Nozzle Sensor

Figure 2B:
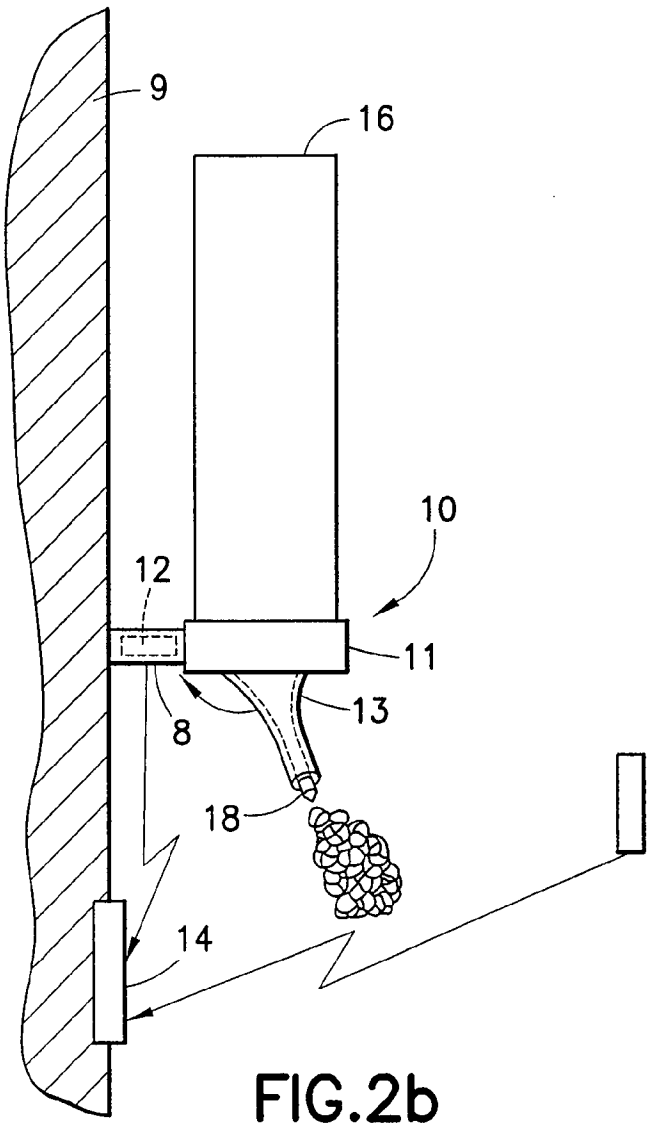
FIGS. 2*a* and 2*b* are side-view diagrams of a dispensing apparatus as in FIGS. 1*a* and 1*b*, used with a disposable foam dispenser and a tag reader/transmitter.
Figure 2A:
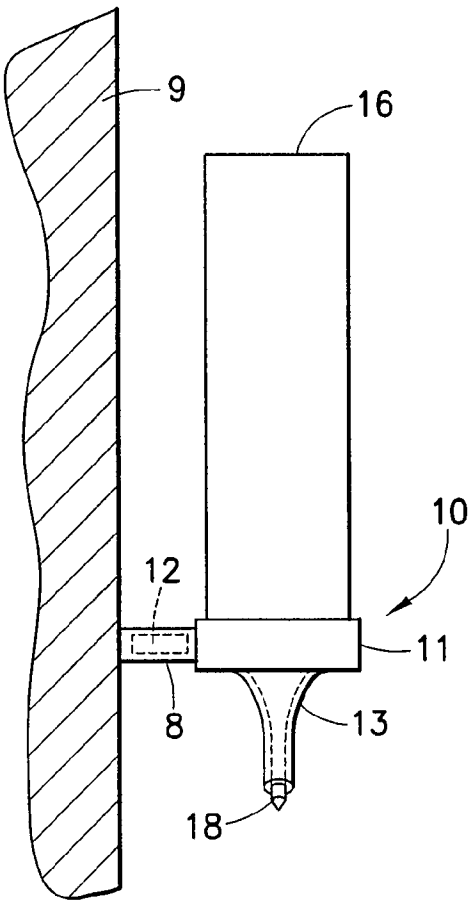

The dispensing apparatus 10 can be used for example with an antiseptic handrub (usually foam) that is packaged in cylindrical containers 16, shown in FIGS. 2*a* and 2*b*, having a nozzle 18. The cylindrical container 16 is supported in the cradle 11 with the nozzle 18 being placed inside the sensor 13 through an opening 7. Manipulation of the nozzle 18 results in dispensation of the handrub in the container 16. Return of the nozzle to its original position stops the dispensation.

As illustrated in FIGS. 2*a* and 2*b*, because the nozzle 18 is placed inside the sensor 13 (jacket), this motion of the nozzle 18 is detected by the sensor 13 and translated into an electrical signal that prompts the wireless transceiver 12 to signal the tag reader/transmitter 14. At this point, the tag reader/transmitter 14 sends the information indicating dispensation of the antiseptic handrub by a specific worker, signaled by the worker's RFID tag 82, read by device 14, which is recorded on the computing device together with the time-stamp.

Flexible Teeth Sensor

Figure 3B:
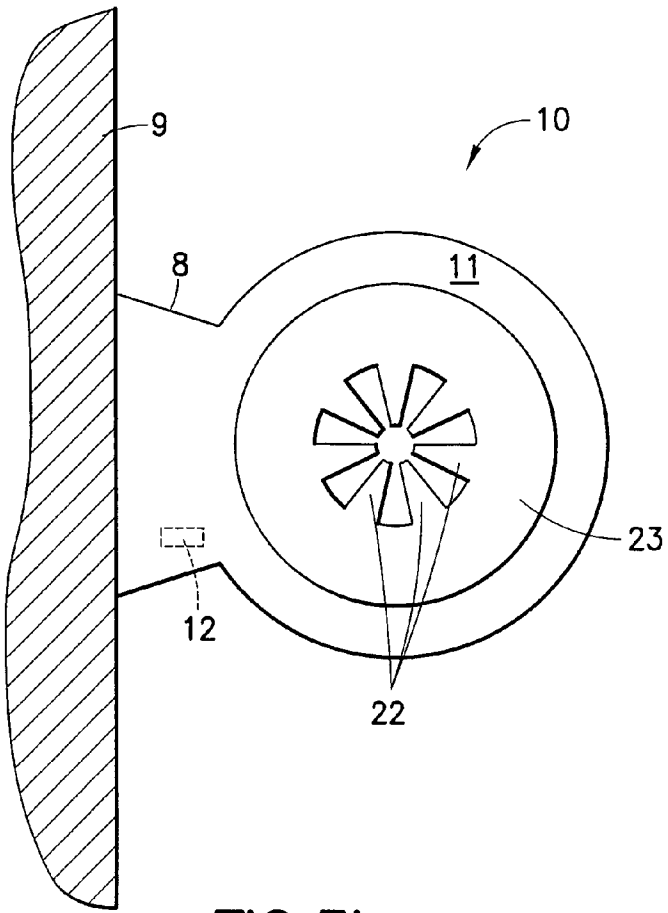
FIGS. 3*a* and 3*b* are side- and top-view diagrams of a dispensing apparatus as in FIGS. 1*a* and 1*b*, used with a disposable wipe dispenser and the tag reader/transmitter.
Figure 3A:
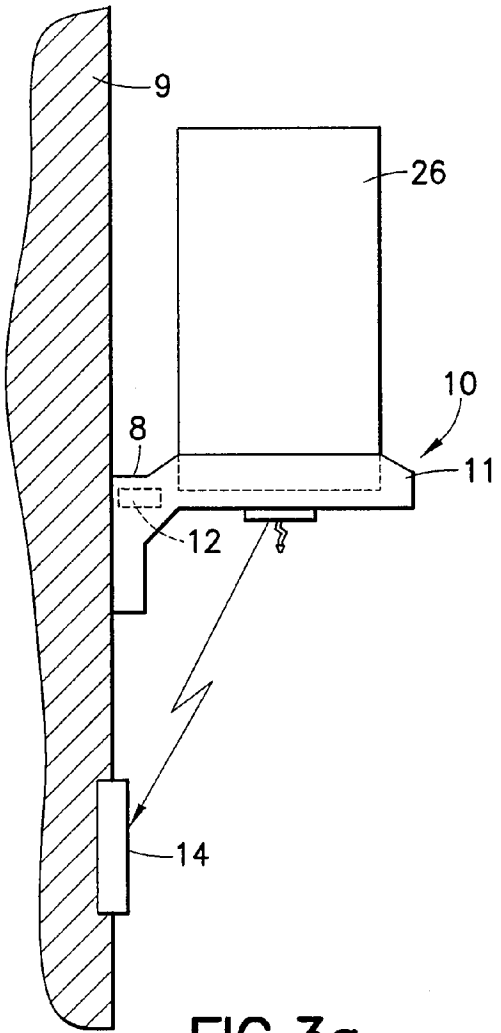

The dispensing apparatus 10 may also be used, as illustrated in FIGS. 3*a*-3*b*, with fomite wipe dispensers. The fomite wipe dispensers are commonly provided in cylindrical plastic containers 26 having a disposable top. The containers dispense alcohol impregnated wipes, e.g., Clorox Handi-Wipes™.

The cylinder container 26 is placed in the cradle 11 of the dispensing apparatus 10 having the wireless transceiver 12 and the tag reader/transmitter 14. In this embodiment, a sensor 23 coupled to the cradle 11 is modified to include teeth 22. As described above, the cradle 11 is fastened to the wall or other holding means 9 via a mounting bracket 8 that includes a wireless transceiver 12. Movement of the teeth 22 of the sensor 23 enables the wireless transceiver 12 to generate and send a signal to the tag reader/transmitter 14. Return of the teeth 22 of the sensor 23 to their original position enables the wireless transceiver 12 to optionally generate and send a second signal to the tag reader/transmitter 14.

The wipes are thus dispensed from the plastic container 26 via an underside of the cradle 11. The wipes pass through an opening 27 in the sensor 23 of flexible plastic teeth/tabs 22. The sensor 23 is triggered by the vibrations that result from the wipe being pulled through the flexible plastic teeth/tabs 22. The sensor 23 then triggers the wireless transceiver 12 to signal the tag reader/transmitter 14 to communicate dispensation of the wipes by an individual worker, who is identified by his RFID tag 82, also read by device 14.

Cap Extension Tab Sensor

Figure 4B:
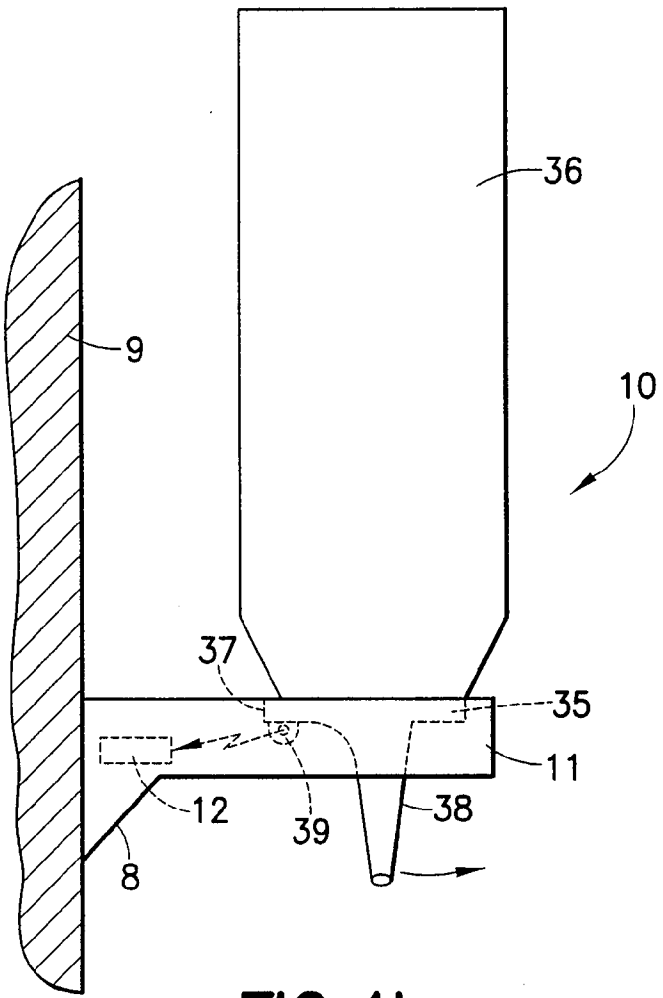
FIGS. 4*a*-4*d* are side-view diagrams of a dispensing apparatus as in FIGS. 1*a* and 1*b*, used with disposable liquid handrub dispenser.
Figure 4A:
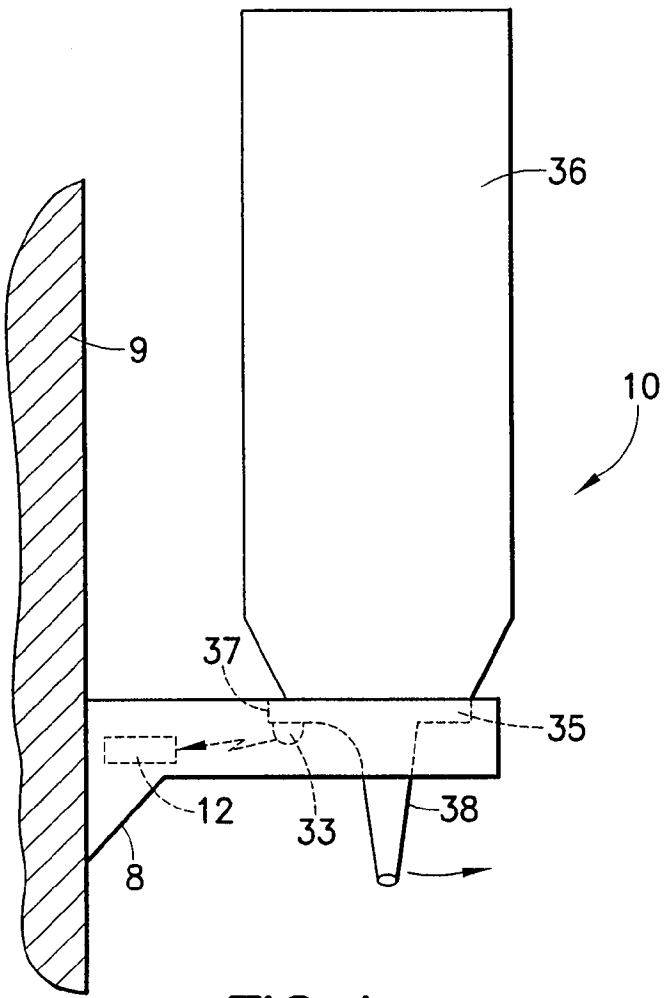

The dispensing apparatus 10 may also be used, as illustrated in FIGS. 4*a*-4*b*, with liquid handrub, e.g., alcohol handrub, contained in canisters 36 having a nozzle. The container 36 is placed in the cradle 11 of the dispensing apparatus 10 having a wireless transceiver 12 and a tag reader/transmitter 14 (not shown). In this embodiment, a sensor 33 coupled to the cradle 11 is implemented as an extension tab. As described above the cradle 11 is fastened to the wall or other holding means 9 via a mounting bracket 8 that includes the wireless transceiver 12. Movement of the container 36 when in use, manipulates the extension tab sensor 33, which enables the wireless transceiver 12 to generate and send a signal. Return of the extension tab sensor 33 to its original position or state enables generation and sending of a second signal.

The extension tab sensor 33 may be implemented as a pressure sensor. The handrub canister 36 may be provided with a tab that sticks out slightly past the edge where the main part of the canister top 35 meets the canister. When the container 36 is placed in the cradle 11, the tab 37 is oriented in the horizontal plane. The tab 37 is connected to the nozzle 38, which is oriented in the vertical plane, by a hard ridge of plastic shaped approximately like a curved L. When the nozzle 38 of the handrub canister 36 is pulled away from the wall 9, the tab is thus pulled downward, thereby contacting a pressure sensor in the canister holder. When the pressure sensor 33 detects pressure, it passes a signal to the wireless transceiver 12 that in turn sends a signal to the initiate the RFID tag reader/transmitter 14.

The extension tab sensor 33 of FIG. 4*a* may be replaced with an optical sensor as illustrated in FIG. 4*b*. Here, when the nozzle 38 of the handrub canister 36 is pulled away from the wall 9, the tab is thus pulled downward, blocking the reception of light by the optical sensor 39, e.g., an "electric eye". When the optical sensor 39 detects cut off or restoration of the light, it provides a signal to the wireless transceiver 12 that in turn sends a signal to initiate the tag reader/transmitter 14.

Figure 4D:
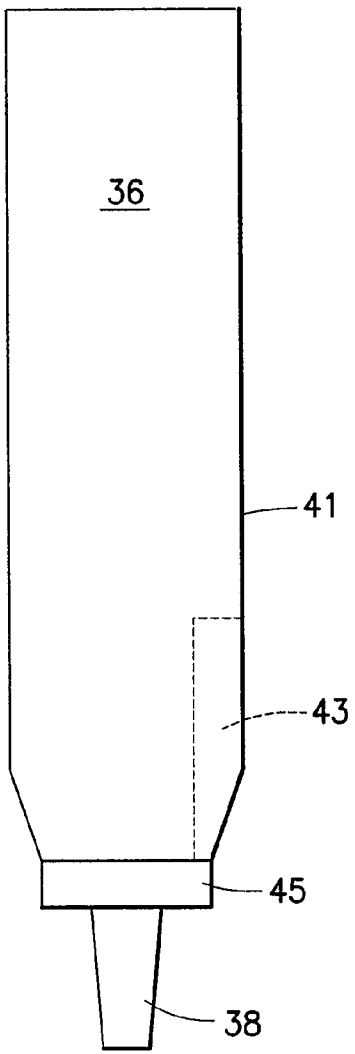
Figure 4C:
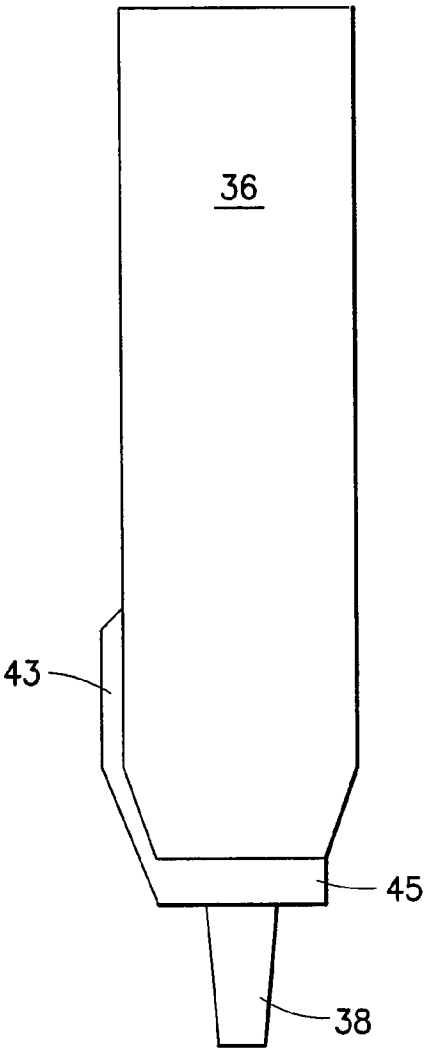

FIGS. 4*c* and 4*d* illustrate a sensor integrated with the top of the handrub canister 36. The disposable canister 36 contains a section that includes a pressure sensor 43 for prompting the wireless transceiver 12 to communicate with the tag reader/transmitter 14. The pressure sensor 43 is affixed to the cap 45 of the canister 36 as illustrated in FIG. 4*c* or the canister wall 41 as illustrated in FIG. 4*d*. The wireless transceiver 12 (RFID chip) can be integrated into the pressure sensor 43.

When the nozzle 38 of the handrub canister 36 is pressed and passage of the handrub through an opening in the cap 45 is enabled, pressure on the pressure sensor 43 changes and the pressure sensor 43 is activated. It is the difference in the pressure on the contents in the canister and the ambient pressure outside the canister that causes the handrub to be expelled through the nozzle 38 when the pressure is applied on the nozzle 38. When the pressure sensor 43 detects this change in the pressure, it turns on the wireless transceiver 12, which communicates with the tag reader/transmitter 14.

A Lever Sensor

Figure 5B:
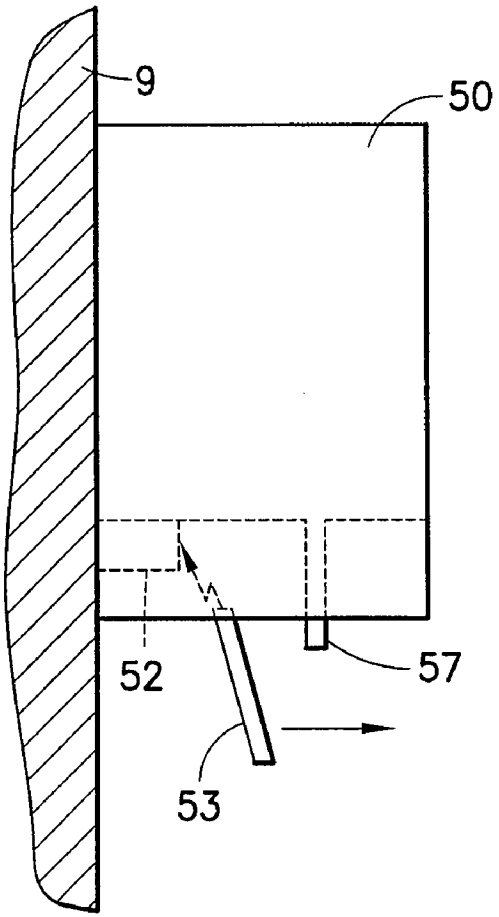
FIGS. 5*a*-5*c* are side-view diagrams of a dispensing apparatus having a lever, used with and without the tag reader/transmitter.
Figure 5A:
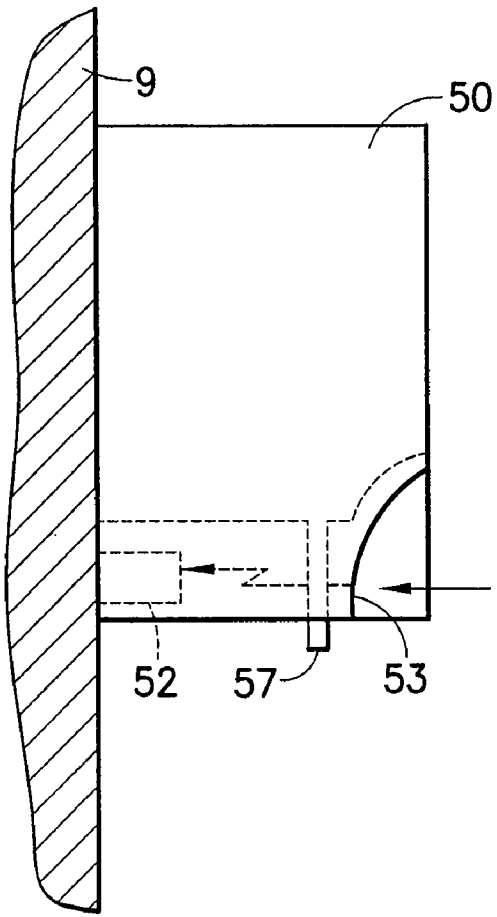

FIGS. 5*a*-5*b* illustrate using the dispensing apparatus 50 with handrub, e.g., alcohol gel. The dispensing apparatus 50 includes a wireless transceiver 52 that is activated by pulling and releasing a lever 53, which may be formed as a handle or a button. The dispensing apparatus 50 is fastened to a wall or other holding means 9. When pulled, the lever 53 allows or initiates release of the handrub stored inside the dispensing apparatus 50 through an opening or a nozzle 57.

The pressure sensor is impacted when the lever (of either the push or pull type) is manipulated. When the lever of the dispenser 50 is pulled or pushed, the lever 53 comes in contact with the pressure sensor. When the pressure sensor detects pressure from the lever 53, it turns on the wireless transceiver that wirelessly signals the tag reader/transmitter 14 (FIG. 1).

Similarly, the dispenser 50 may use an optical sensor e.g., an "electric eye" that is affected when the lever of the push or pull type dispenser 50 is manipulated. When the lever 53 is pulled or pushed the reception of light by an optical light receiver is blocked, causing the sensor to turns on the wireless transceiver 52 that wirelessly signals the tag reader/transmitter 14.

Those skilled in the art will appreciate that the dispenser 50 of FIG. 5 can operate without the use of the sensor. The lever 53 can easily turn on and off simple circuitry that will trigger turning on of the wireless transceiver 52 without the use of an intervening sensor.

Similarly, those skilled in the art will appreciate that the wireless transceiver 12, 52 can be substituted by a simple wired circuit and that the tag reader/transmitter 14 can be placed on the mounting bracket 8 or cradle 11 such that the sensors 13, 23, 33, 43, and 52 or the lever 53 will alert the tag reader/transmitter 14 to report the handwashing event, thus eliminating the need for the wireless transceiver 12, 52 or a wired connection. Furthermore, the device 14 can itself be a wireless or wired device, i.e., it can transmit to the computer system 80 via a wireless or wired connection.

The wireless transceiver 12 of the dispensing apparatus may be positioned on the mounting bracket 8 as illustrated in FIGS. 1-4. Alternatively, the wireless transceiver 12 may be disposed on the cradle 11, or with products like the handrub canister 36.

The bulk of the pressure sensor 43 may be located on the canister cap 45, as shown in FIG. 4*d*, but affixed to the exterior, with only a part of the pressure sensor being located inside the canister cap 45. Alternately, the pressure sensor 43 may reside mostly or entirely within the canister and the canister cap.

As discussed above, the present invention may optionally record both the start and end of the handwashing with corresponding time stamps. This allows the use of the present invention in monitoring dispensation of cleansing products and provides to the facility management an ability to calculate and continually monitor a level of the cleansing products, e.g., antibacterial foam, alcohol handrub, wipes, soap, etc., in the dispensing apparatus, without the need of physical inspection. For example, the computing device may create alarms, e.g., send e-mails, sound alarms, turn on or blink an indicator light, etc., to alert the medical facility management when the level of the cleansing content, e.g., content of the containers 16, 26, and 36 nears some pre-set value. The preset level value may be entered into the above-discussed compliance guideline database or a separate database or file. Additionally, the computing device may send reports or e-mails if it is detected that certain personnel have not adhered to the specified hand hygiene protocol for, or within, a certain time period.

Dispensing Cleansing Substance Used with Water

The above discussion centered on antiseptic hand rubs and wipes provided in disposable containers and did not require the use of water. The discussion will now turn to using the cleansing substance dispensing apparatus together with water dispensing at sink stations.

Figure 5C:
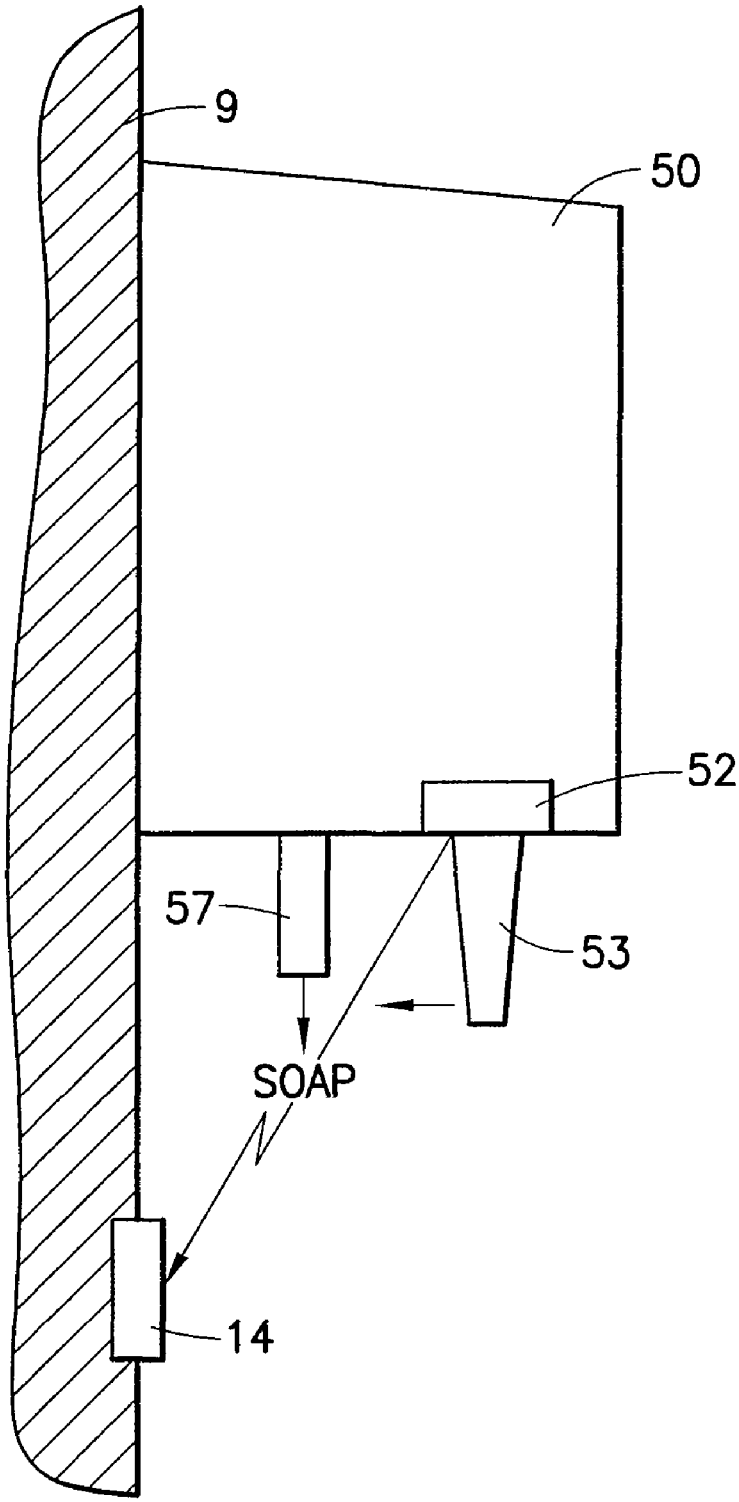

FIG. 5*c* illustrates a dispensing apparatus 50 having the wireless transceiver 52 that is, as discussed above, activated by pulling and releasing the lever 53. The dispensing apparatus 50 is fastened to the wall or other holding means 9 and may be filled with liquid soap that often comes in disposable containers. When pulled, the lever 53 releases a flow of liquid cleanser, i.e., soap, stored inside the dispensing apparatus 50 through an opening or a nozzle 57.

Figure 6C:
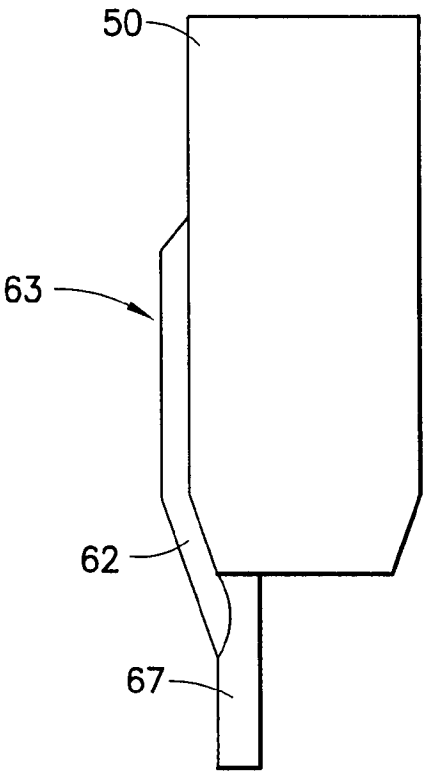
FIGS. 6*a*-6*c* are diagrams of a dispensing apparatus used with a tag reader/transmitter.
Figure 6B:
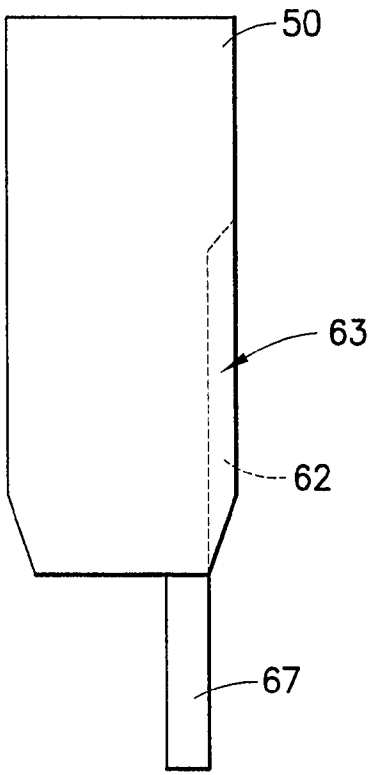
Figure 6A:
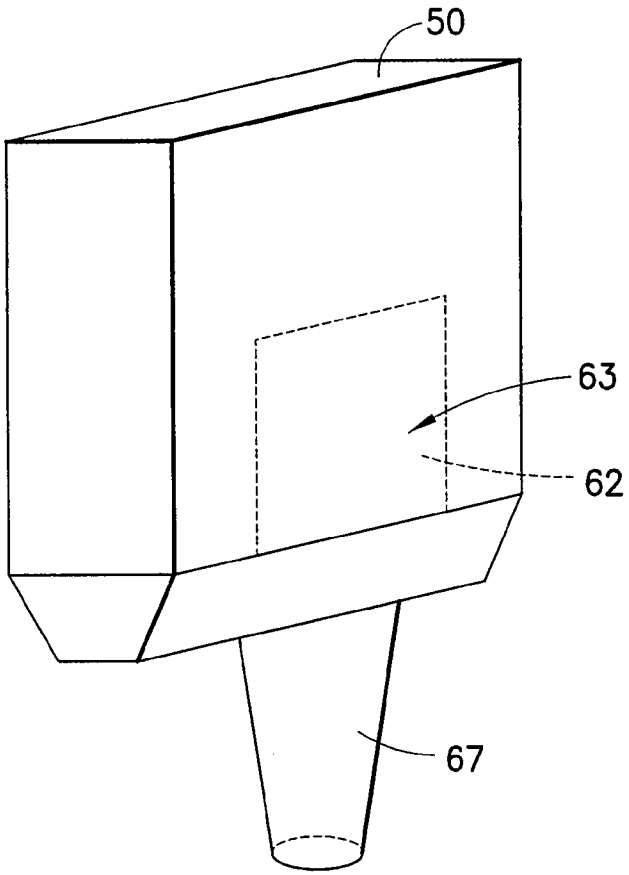

Alternatively, as illustrated in FIGS. 6*a*-6*c*, a sensor 63, e.g., a pressure sensor, placed inside or outside of the dispensing apparatus 50 may be used instead of the lever 53 (FIG. 5*c*) for activating the wireless transceiver 62, which may be linked to or located in close proximity to the sensor 63. When pressure is applied to the nozzle 67 of the dispenser 50 or to any part of the pouch or the dispenser 50, pressure is placed upon the soap pouch located inside the dispenser 50. This increased pressure causes the soap to be pushed out of the pouch through the nozzle 67. This applied pressure will be detected by the sensor 63, which in turn will activate the wireless transceiver 62.

Additionally, the bulk of the sensor 63 may be located on the pouch (not shown) but be affixed to the exterior of the dispensing apparatus 50, with only a part of the sensor 63 being located inside the pouch.

Returning to FIG. 5*c*, a signal from the wireless transceiver 52 indicating initiation and termination of soap dispensation, thereby activates the tag reader/transmitter 14, which wirelessly communicates worker tag information to the computing device for recording the identity of the worker using the dispensing apparatus 50 together with start and end times of that use.

Figures 7A, 7B, 7C:
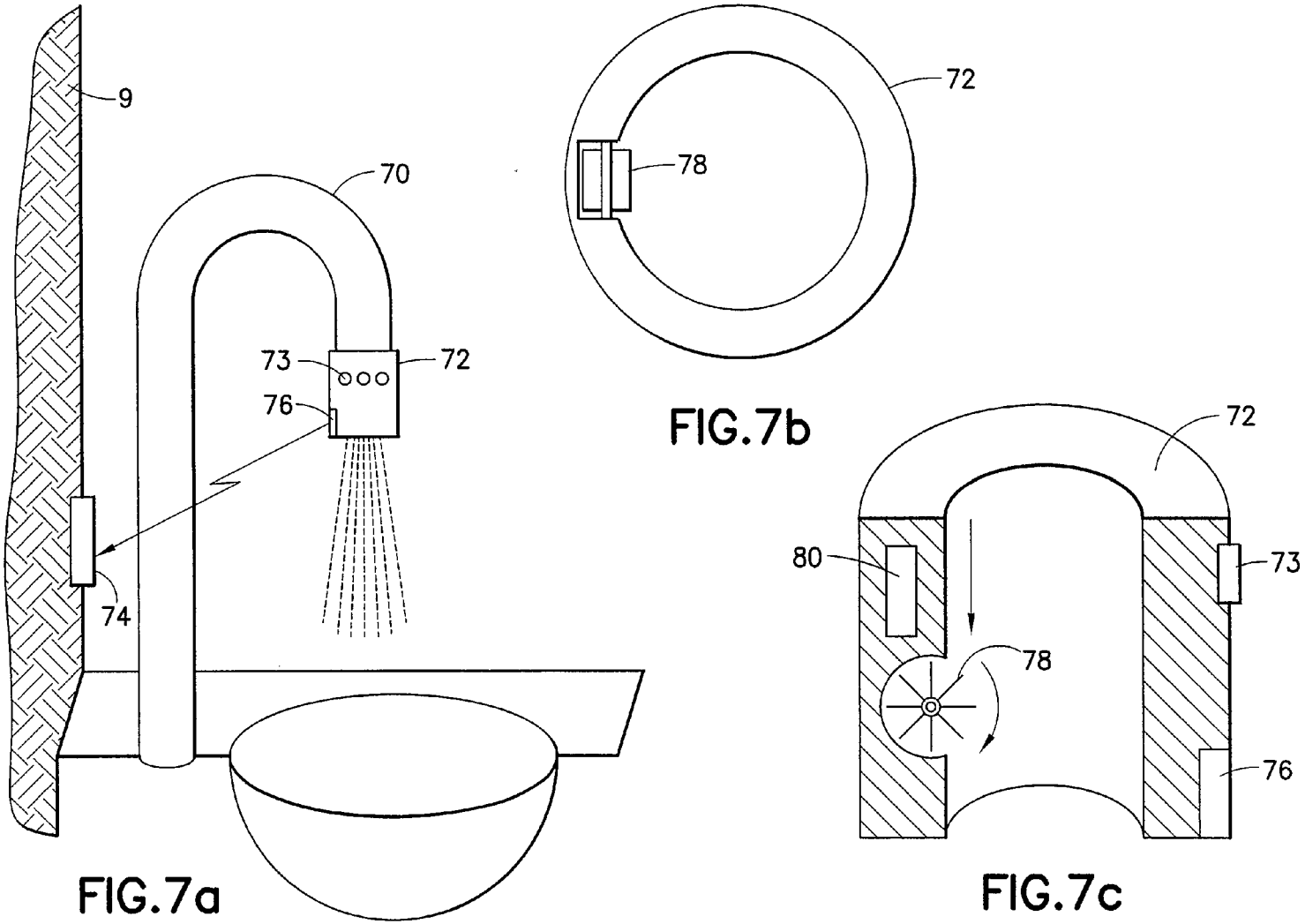
FIG. 7*a* is a side-view diagram of a faucet utilizing an extension of the present invention having a paddle wheel, LED lights, and a wireless transceiver.
FIGS. 7*b*-7*c* are horizontal and vertical cutaway diagrams of the faucet extension of FIG. 7*a*.

At the same time, a pulse may be sent by the wireless transceiver 52, the tag reader/transmitter 14 of the dispensing apparatus 50 or by the computing device to a tag reader/transmitter 74 of a faucet 70 illustrated in FIGS. 7*a*-7*c*. Because of their proximity, the tag reader/transmitters 14 and 74 may be the same device.

The signal received by the tag reader/transmitter 74 may direct an extension 72 on the faucet 70 to display blinking lights, e.g., green or other colors, to indicate to the worker the recommended duration of handwashing, e.g., 15 seconds. This duration information or coloring scheme and blinking pattern of the lights may be stored in the compliance guideline database or a separate database or file on the computing device.

The faucet extension 72 is preferably adapted to screw into a nozzle of standard faucets and monitors the flow of water through the faucet using a sensor, e.g., a paddle wheel 78. Revolutions of the paddle wheel 78 are measured and forwarded by a wireless transceiver 76 to the tag reader/transmitter 74, which reports this together with information identifying the worker using the faucet to the computing device. Additionally, the presence of water flow may be measured or detected via other means, such as conduction, impedance, optical, etc.

The faucet extender includes LED or other lights that blink on and off for a discrete period of time and provides an alert, e.g., beeps, at the end of the handwashing cycle. A combination of different LED light colors, e.g., green, yellow, and red, may be used to communicate to the worker how much time is remaining in the handwashing cycle. The paddle wheel 78 may also generate electricity to power the LED(s) 73 and/or enable the alarm. Any excess electricity produced by the paddle wheel may be stored in a capacitor 80.

As discussed above, the supply level of soap and the amount of water used can be easily monitored and controlled through comparison of timestamps from the two signals reported by the tag reader/transmitters connected to the handwashing apparatus to the computing device. The tag reader/transmitter and the wireless transceiver may be used interchangeably. One of the tag reader/transmitter and the wireless transceiver may be excluded from the dispenser.

The detection of usage of cleansing substances or hand hygiene products described above may also include placing a housing around the cleansing substance or hand hygiene dispensing apparatus, wherein the placement of a hand interferes with a light, e.g., electric eye, or radio, e.g., theramin, signal.

Additionally, video or other screens may be integrated into the system to provide visual/auditory information designed to inform or motivate the worker. The screen may be of varying sizes and placed next to the cleansing substance dispensers or on the way from various areas of the facility to the cleansing substance dispensers.

Although the present invention has been described in relation to particular embodiments thereof, many other variations and modifications and other uses will become apparent to those skilled in the art. It is preferred, therefore, that the present invention not be limited by the specific disclosure herein.

What is claimed is:

1. A system for monitoring compliance with handwashing protocols by a plurality of workers, each worker carrying a wireless tag having a worker identifier, the monitoring being performed in a facility having a plurality of areas, the system comprising:

a plurality of wireless tag reader/transmitters each having an area identifier, at least one wireless tag reader/transmitter being positioned in each of the areas and each wireless tag reader/transmitter being capable of reading the worker identifier stored in the wireless tag when the worker is within range of the wireless tag reader/transmitter and further capable of transmitting the worker and area identifiers to at least one computing device; and at least one of said wireless tag reader/transmitters being disposed at a handwashing station;

wherein the at least one wireless tag reader/transmitter reads the worker identifier when the worker manipulates a device at the handwashing station dispensing a washing substance and transmits the worker and area identifiers to the at least one computing device.

2. The system of claim 1, wherein the handwashing station is selected from at least one of a cleanser dispenser and a sink with a faucet.

3. The system of claim 1, wherein, the at least one handwashing station further comprises a sensor for sensing the worker manipulating the at least one handwashing station and triggering the wireless tag reader/transmitter to send a first signal to the computing device at the beginning of handwashing and further for sensing that handwashing is complete and triggering the wireless tag reader/transmitter to send a second signal to the computing device, whereby the duration of handwashing is computed by a time difference between the first and second signals.

4. The system of claim 1, wherein the handwashing station comprises a water faucet, and the faucet includes a device for measuring the amount of water used and for generating a signal to be returned to the computing device related to the amount of water used.

* * * * *